US011187173B2

(12) United States Patent
Marconi

(10) Patent No.: US 11,187,173 B2
(45) Date of Patent: Nov. 30, 2021

(54) SYSTEM FOR LIMITING A REVOLUTION SPEED OF AN INTERNAL COMBUSTION ENGINE

(71) Applicant: FERRARI S.p.A., Modena (IT)

(72) Inventor: Stefano Marconi, Modena (IT)

(73) Assignee: FERRARI S.P.A., Modena (IT)

( * ) Notice: Subject to any disclaimer, the term of this patent is extended or adjusted under 35 U.S.C. 154(b) by 238 days.

(21) Appl. No.: 16/431,904

(22) Filed: Jun. 5, 2019

(65) Prior Publication Data

US 2019/0383224 A1 Dec. 19, 2019

(30) Foreign Application Priority Data

Jun. 8, 2018 (IT) ..... 102018000006158

(51) Int. Cl.
*F02D 41/04* (2006.01)
*F02D 41/14* (2006.01)

(52) U.S. Cl.
CPC ..... *F02D 41/045* (2013.01); *F02D 2041/141* (2013.01); *F02D 2041/1418* (2013.01); *F02D 2200/101* (2013.01); *F02D 2200/1002* (2013.01)

(58) Field of Classification Search
CPC ..... F02D 41/045; F02D 2041/141; F02D 2041/1418; F02D 2200/1002; F02D 2200/101; F02D 2250/26; F02D 41/0225; F02D 31/009; F02D 31/006
See application file for complete search history.

(56) References Cited

U.S. PATENT DOCUMENTS 5,669,354 A * 9/1997 Morris ..... F02D 41/1498 123/406.24
6,371,081 B1 * 4/2002 Hawkins ..... F02D 31/007 123/339.14
6,516,778 B1 * 2/2003 Light ..... B60K 31/00 123/352
6,652,414 B1 * 11/2003 Banks, III ..... F16H 61/21 477/32
6,782,868 B1 * 8/2004 Doering ..... F02D 31/007 123/333

(Continued)

FOREIGN PATENT DOCUMENTS

FR 2791396 A1 9/2000

OTHER PUBLICATIONS

International Search Report issued in Italian Application No. 201800006158, completed Feb. 19, 2019; 10 pages.

*Primary Examiner* — Phutthiwat Wongwian
*Assistant Examiner* — Susan E Scharpf
(74) *Attorney, Agent, or Firm* — Cantor Colburn LLP

(57) ABSTRACT

A method for limiting a revolution speed of an internal combustion engine (E) of a sports car, the method comprising a first step (Step 1) of acquiring a nominal speed value of said internal combustion engine, a second step (Step 2) of measuring a revolution speed of said internal combustion engine, when (CHK) a measured revolution speed of said internal combustion engine has reached (yes) an activation speed approximately equal to said nominal speed, the method comprising a third step (Step 3) of setting a predetermined initial torque value (a) to be delivered by said internal combustion engine and simultaneously a fourth step (Step 4) of carrying out a feedback control of a torque delivery of said internal combustion engine.

13 Claims, 6 Drawing Sheets

(56) References Cited

U.S. PATENT DOCUMENTS

| | | | | |
|---|---|---|---|---|
| 6,947,824 | B1 * | 9/2005 | Livshiz | F02D 31/003 701/103 |
| 8,594,904 | B2 * | 11/2013 | Livshiz | F02P 5/1504 701/102 |
| 8,744,716 | B2 * | 6/2014 | Kar | F02D 31/001 701/84 |
| 2001/0021893 | A1 * | 9/2001 | Weisman, II | B60K 31/047 701/114 |
| 2003/0216847 | A1 * | 11/2003 | Bellinger | B60W 30/1819 701/51 |
| 2006/0032480 | A1 * | 2/2006 | Bader | F02D 31/006 123/350 |
| 2007/0032340 | A1 * | 2/2007 | Hrovat | F16H 63/502 477/107 |
| 2008/0125951 | A1 * | 5/2008 | Livshiz | F02D 13/0219 701/101 |
| 2017/0356374 | A1 * | 12/2017 | Rollinger | F02D 13/06 |

* cited by examiner

SYSTEM FOR LIMITING A REVOLUTION SPEED OF AN INTERNAL COMBUSTION ENGINE

CROSS-REFERENCE TO RELATED APPLICATIONS

This Patent Application claims priority from Italian Patent Application No. 102018000006158 filed on Jun. 8, 2018, the entire disclosure of which is incorporated herein by reference.

TECHNICAL FIELD OF THE INVENTION

The invention relates to the field of devices designed to control an internal combustion engine and, in particular, to the field of rev limiters.

STATE OF THE ART

Internal combustion engines comprise one or more pistons associated with relative cylinders. The pistons are connected to a crankshaft by means of a known crank mechanism.

In relation to the constructive features of an internal combustion engine, a maximum revolution speed is defined, which is also known as "nominal speed" and can be reached by the internal combustion engine without being subjected to damages.

In high-performance internal combustion engines, there is a so-called rev limiter, which acts upon the engine, preventing it from exceeding the nominal speed.

In spark-ignition engines, the action of the rev limiter can affect the fuel supply and/or the power supply of the spark-ignition system.

The vehicle provided with the internal combustion engine can be in any operating condition; for example, the driver can press the accelerator pedal either gradually, up to the maximum inclination thereof, or quickly and, furthermore, the vehicle can travel uphill, on a level road or downhill and with different gear ratios. In other words, the dynamics of the engine and the load conditions can be very different.

In order to take into account all these possible situations, the prior art implements a rev limiter which a) predicts the progression of the revolution speed of the engine and, based on said progression, b) limits the torque thereof by means of a feedback control on the torque delivered by the internal combustion engine. The more the engine approaches the relative nominal speed, the more relevant the limitation of the control becomes.

This type of control negatively affects the performances of the engine, especially when said engine is used in a high-performance sports car, since the torque delivery curve is reduced, depending on the circumstances and, above all, based on the gear ratio adopted during the progression, with the consequence that the behaviour of the vehicle changes more than expected as a function of the ratio selected with the gearbox.

FIG. 1 shows the effects of the intervention of a rev limiter by means of a dashed line curve. The rev limiter predicts a progression of the speed of the engine, according to the fine continuous curve, and controls the delivered torque by means of a feedback control based on said prediction.

The progression curve of the ideal limitation is represented with a thick, continuous line and consists of two straight segments, a first straight segment showing the (free) progression of the speed of the engine over time in predetermined operating conditions and a second segment perfectly overlapping the nominal speed, which is indicated by means of a horizontal, straight, dashed line.

The progression curve of the prior art significantly differs from the ideal one.

A vertical, straight, dashed line indicates the time instant in which the rev limiter according to the prior art starts limiting the torque delivered by the internal combustion engine.

At the intersection between said vertical, straight, dashed line and the progression curve of the limitation operated by means of the aforesaid feedback control of the prior art there is a horizontal, straight, dashed half-line, which intersects the ordinate axis and points out, in terms of revolutions, when the rev limiter of the prior art starts acting, limiting the delivered torque. This limitation can already starts at $\Delta rpm=1000$ revolutions/minute before reaching the nominal speed.

This implies that the nominal speed is reached only many seconds later, thus undoing all the efforts made to obtain a particularly high-performance internal combustion engine.

If not specifically excluded by the detailed description below, the information contained in this part should be considered as an integral part of the detailed description itself.

SUMMARY OF THE INVENTION

The object of the invention is to improve the performances of an internal combustion engine provided with a rev limiter.

The idea on which the invention is based is that of activating the feedback control only when the engine has reached or is close to the relative nominal speed.

In other words, the rev limiter controlling the torque delivered by the internal combustion engine remains deactivated as long as the internal combustion engine does not reach a predetermined intervention speed, which is smaller than or equal to the nominal speed.

In other words, the contribution of the feedback control is ignored or cancelled up to the intervention speed, which coincides with or is 1% smaller than the nominal speed.

Furthermore, simultaneously with the activation of the feedback control, the internal combustion engine is controlled in terms of delivered torque, so as to deliver a predetermined initial torque, which can be set.

The feedback control, according to the invention, always acts upon the actual (measured) speed of the internal combustion engine and not upon a predicted speed.

Said predetermined initial torque is preferably set for each gear ratio that can be selected. Therefore, when the internal combustion engine reaches the aforesaid intervention speed, it is controlled so as to deliver a predetermined initial torque, while the feedback control is activated, which, from that moment on, autonomously controls the torque to be delivered by the internal combustion engine in order to reach and maintain the nominal speed.

Hence, the torque control is carried out by making corrections to the aforesaid predetermined initial torque depending on possible external interferences.

As a result, the progression curve limited by means of the invention can overlap the ideal progression curve.

The predetermined torque can be the one needed to cause the internal combustion engine to reach and/or maintain the nominal speed, or It can be smaller than the torque needed to reach and/or maintain the nominal speed;

It can be greater than the torque needed to reach and/or maintain the nominal speed, in which case the supply of the internal combustion engine is cut-off until a reactivation speed is reached, at which the supply is restored.

In both these cases oscillations are triggered, which are due to the intervention of the feedback control, which respectively compensates the setting of a predetermined initial torque which is insufficient to keep the engine at the nominal speed;

the cut-off of the supply of the engine.

This leads to two significant technical advantages:

It allows the tone of the exhaust to be adjusted without acting upon the exhaust line of the engine;

It allows pulsations to be triggered in the devices of the exhaust gas after-treatment system, which help reduce the pollutants that settled in the devices.

The frequency and the magnitude of the oscillations can be set by acting upon the parameters of the feedback control of the torque delivered by the internal combustion engine and, respectively, by changing the value of the predetermined initial torque or of the supply reactivation speed.

The claims describe preferred embodiments of the invention, thus forming an integral part of the description.

BRIEF DESCRIPTION OF THE FIGURES

Further objects and advantages of the invention will be best understood upon perusal of the following detailed description of an embodiment thereof (and of relative variants) with reference to the accompanying drawings merely showing and non-limiting examples, wherein:

FIG. 5 shows a flowchart explaining the method for limiting an internal combustion engine according to the invention, whereas

In FIG. 5, which shows a flowchart, the dashed line blocks are optional.

In FIG. 4, the connection dashed lines represent data connection lines, regardless of whether they are electrical cables or communications carried out by means of wireless transmission systems.

In the figures, the same numbers and the same reference letters indicate the same elements or components.

For the purposes of the invention, the term "second" component does not imply the presence of a "first" component. As a matter of fact, these terms are only used as labels to improve clarity and should not be interpreted in a limiting manner.

The elements and features contained in the different preferred embodiments, drawings included, can be combined with one another, without for this reason going beyond the scope of protection of this patent application, as described hereinafter.

DETAILED DESCRIPTION OF EMBODIMENTS

Figure 1:
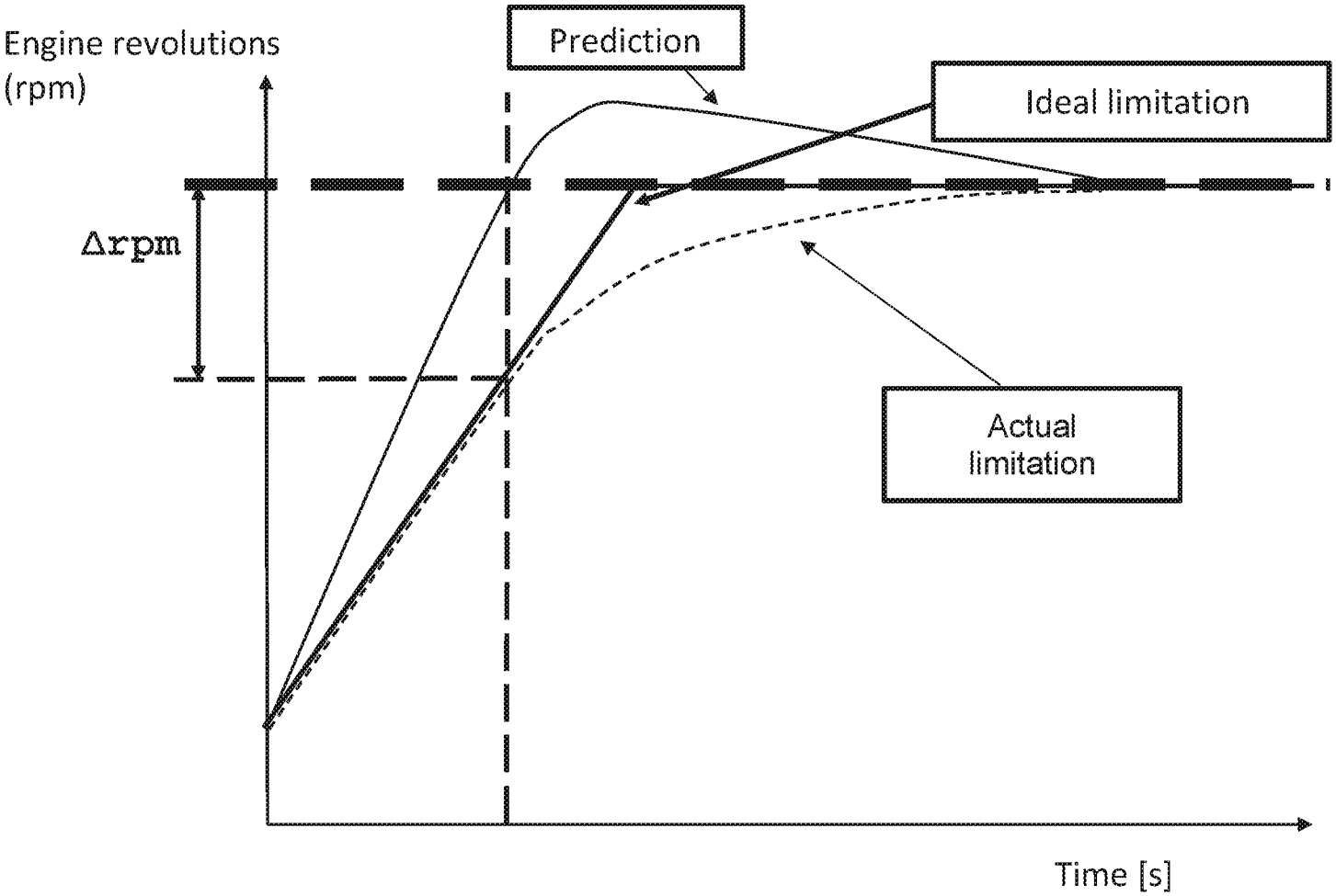
Fig. 1 (Prior art)
FIG. 1 shows a comparison between the progression of an ideally limited internal combustion engine and a limitation operated by means of a feedback control which limits the speed of the engine by controlling the torque delivered by it.
Figure 2:
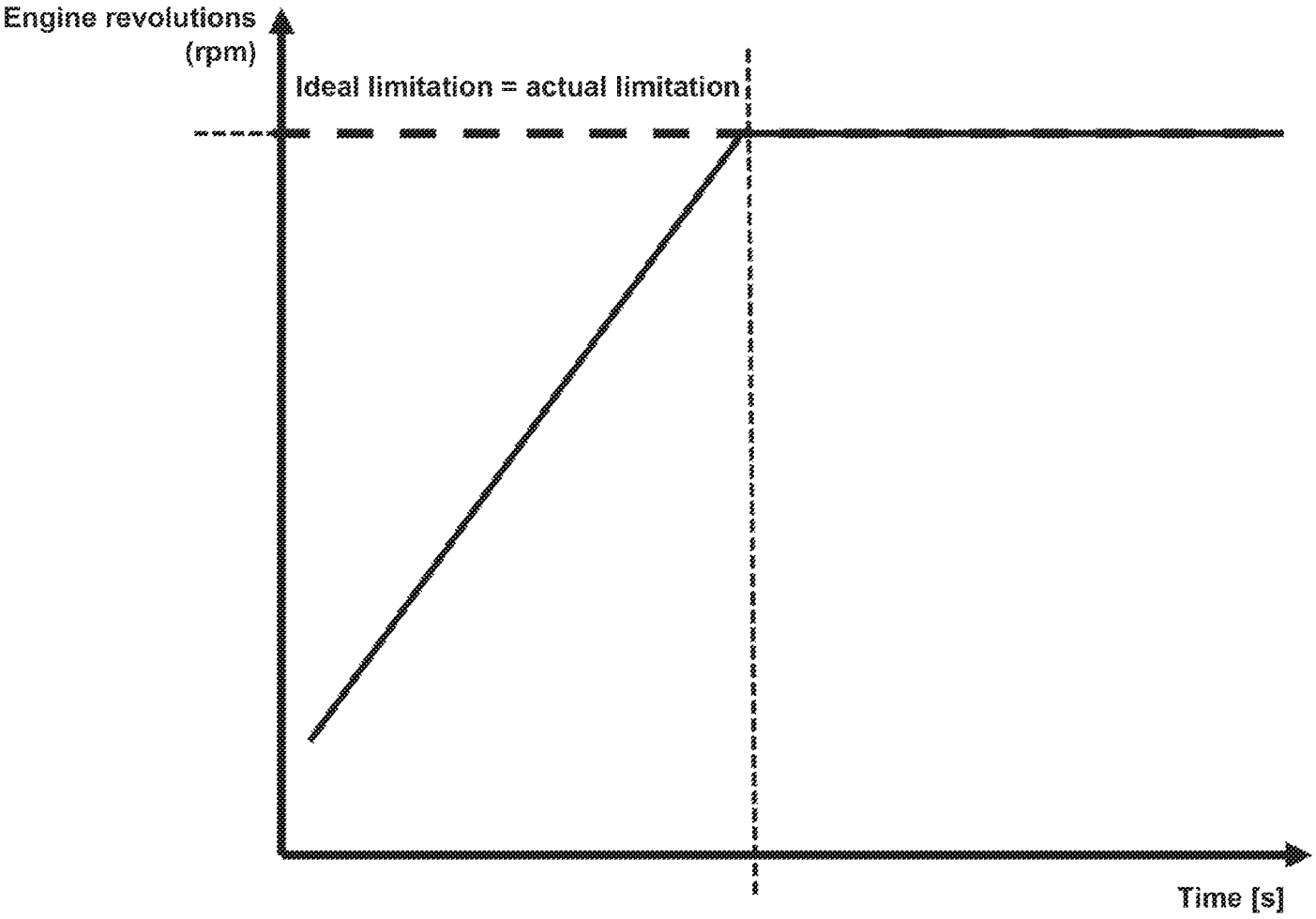
FIG. 2 shows a comparison between the progression of an ideally limited internal combustion engine and a limitation operated by means of the strategy according to the invention.

With reference to FIG. 2, according to the invention, when the internal combustion engine reaches a predetermined "intervention speed", which can coincide with the nominal speed, namely the limit speed beyond which the internal combustion engine risks being damaged, the torque delivered by the internal combustion engine (step 3) is set at a predetermined value, hereinafter referred to as "predetermined initial torque" and, at the same time, a feedback control is activated (step 4) to control the torque delivered by the internal combustion engine based on the revolution speed of the engine.

Therefore, the value of the predetermined initial torque represents a so-called set-point value for the feedback control and can identified off-line on the bench, namely empirically, or can be calculated.

The predetermined initial torque is made a function (mapped) of the gear ratio selected by the sports car when the revolution speed of the engine reaches said activation speed.

Therefore, if the gearbox is designed to express a predetermined number of gear ratios, then there are the same number of values of said predetermined initial torque, in a relationship 1:1.

The value of the activation speed preferably is close to or coincides with the one of the nominal speed. It can differ from the value of the nominal speed at the most by 1%. The reasons are discussed below.

Therefore, when we claim that the activation speed is "approximately equal" to the nominal speed, we mean that it is slightly smaller than or equal to the nominal speed.

According to a preferred variant of the invention, the values of the predetermined initial torque are properly selected so as to stabilize the speed of the internal combustion engine at the nominal value, but there are unpredictable operating conditions which need to be taken into account. For this reason, in the instant in which the predetermined initial torque is set, the classic feedback control is activated so as to receive, as an input, a measured speed signal of the internal combustion engine and control the torque delivered by the internal combustion engine accordingly, so that the latter reaches and/or maintains said nominal speed value.

According to a preferred variant of the invention, when the nominal speed is reached, oscillations are triggered in the revolution speed with relative peaks coinciding with the value of said nominal speed. Both the magnitude and the frequency of said oscillations are variable so as to obtain two effects:

A particular "natural" sound emitted by the exhaust line of the car,

A removal of carbon deposits from the reduction devices defining the exhaust line, known as "after-treatment system" (ATS).

Figure 3:
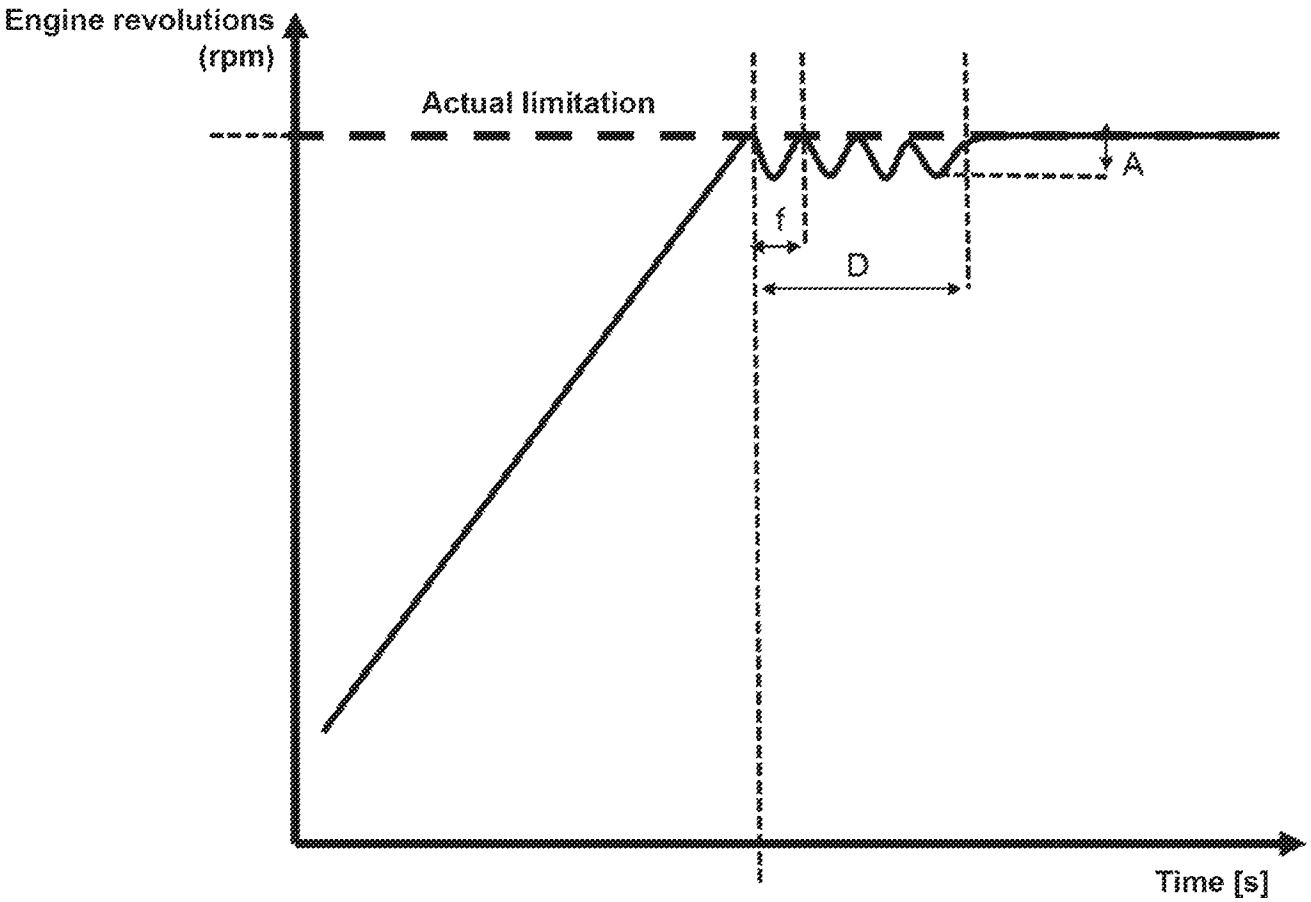
FIG. 3 shows a preferred implementation of the invention, in which a pulsation is triggered in the revolution speed of the engine.

An example of these oscillations is shown in FIG. 3, after having reached the nominal speed.

This operation can be carried out any time the internal combustion engine reaches the nominal speed or can be requested through the activation of a dedicated button available on the dashboard of the sports car.

The mean value of the revolution speed of the engine is smaller than the nominal speed, so that the positive peaks of said oscillations coincide with said nominal speed of the internal combustion engine.

Said mean oscillation speed ranges, once again, between 90% and 100% of the nominal speed as far as the magnitude A is concerned.

After a time interval D whose duration can be set, the predetermined initial torque is preferably set at the set-point value that allows the speed of the internal combustion engine to stabilize at the nominal speed.

For example, in FIG. 3, this setting is carried out four times, performing 4 cycles of approach to the nominal speed one after the other. Evidently, only the last cycle actually stabilizes the speed of the internal combustion engine at the relative nominal speed.

In order to activate these oscillations, different operations can be carried out; for example, upon reaching of the nominal speed, a torque that is sufficiently smaller than the one needed to reach and/or maintain the nominal speed is set as predetermined initial torque. Therefore, the engine physiologically decelerates to a speed called "reactivation speed", which is smaller than the activation speed. By so doing, the feedback control causes the engine to deliver a torque that is greater than the predetermined initial torque so as to make up for the speed reduction due to the setting of the predetermined initial torque. Upon reaching of the nominal speed, the cycle is repeated setting the predetermined initial torque again.

According to a preferred variant of the invention, simultaneously with the aforesaid third step (step 3) and fourth step (step 4), a sixth supply-cut-off step (step 6) is carried out, which is generally referred to as cut-off. In these conditions the opening of the electrically operated injectors, which are adapted to injected fuel into the cylinders of the internal combustion engine, is not carried out.

The cut-off can affect all cylinders or only a part thereof.

The speed of the engine immediately decreases for the load defined by the car, similarly to what described above. When the speed of the engine reaches a "reactivation speed", which is smaller than the activation speed, the supply of the engine is restored (or restored for all cylinders) and, therefore, the feedback control causes the engine to substantially deliver the maximum torque available.

After having reached the nominal speed, the cut-off is triggered again and the cycle is repeated obtaining the effect described above.

The feedback control, like any other control implementing at least one proportional controller and, preferably, also an integral controller, is capable of facing and correcting the response of the engine (revolution speed) in the presence of external interferences, such as a load variation, an uphill or downhill road, wind etc. The intervention speed should be slightly smaller than the nominal speed so as to allow the "integral portion" of the feedback control to operate in an effective manner.

Therefore, the aforesaid predetermined torque, which is set when the nominal speed is reached, represents an initial value of the torque delivered by the internal combustion engine, upon which the controller starts acting in order to correct it based on the speed signal received.

This method is preferably carried out in a continuous manner, continuously acquiring (step 2) the value of the speed of the internal combustion engine and comparing (CHK) this value with a nominal speed value of the internal combustion engine, which was previously acquired (step 1).

Figure 5:
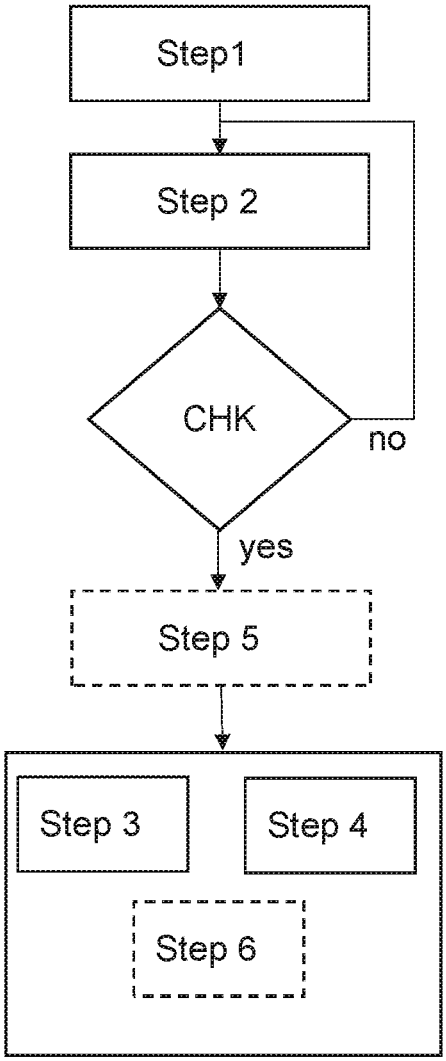
Figure 5A:
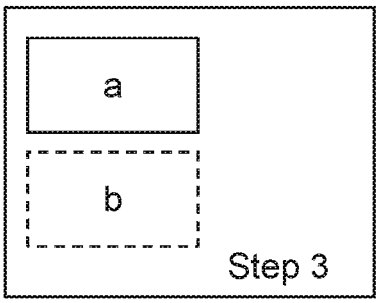
FIG. 5*a* shows a detail of a block of the flowchart of FIG. 5.

To this aim, FIG. 5 shows a preferred flowchart for the implementation of the method according to the invention.

Steps 5 and 6 evidently are optional, just like portion (b) of step 3, which involves selecting the value of the predetermined initial torque to be set as a function of the acquisition (step 5) of the current gear ratio.

Similarly, if the triggering of the oscillations is to be carried out, then the cut-off procedure (step 6) also needs to be activated simultaneously with steps 3 and 4.

Figure 4:
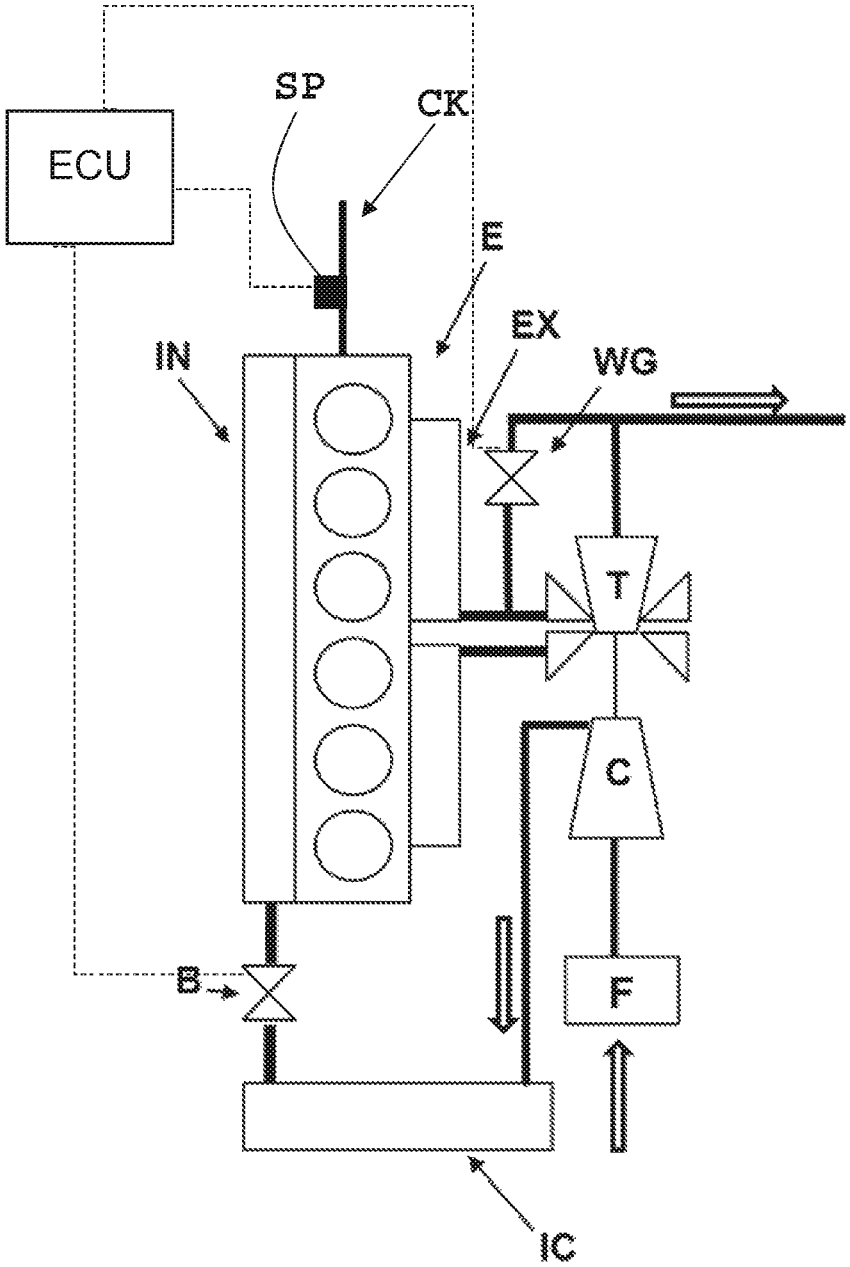
FIG. 4 schematically shows an example of an internal combustion engine implementing the system according to the invention.

FIG. 4 shows an internal combustion engine E comprising one or more cylinders, which are connected to a crankshaft CK, which is associated with a speed sensor SP.

It is, for example, a spark-ignition engine and comprises a throttle valve B, which adjusts an intake of air into the relative intake manifold IN.

A processing unit ECU controls the internal combustion engine through the throttle valve and/or through the control of the ignition, so as to obtain the rev limiter described above.

The internal combustion engine can further comprise a supercharging unit TC comprising a turbine T, which is operatively connected to the exhaust manifold EX of the internal combustion engine, and a compressor C, which is operatively connected to the intake manifold IN through the aforesaid throttle valve B.

A filter F can be present in order to filter the fresh air flowing into the internal combustion engine E and there can also be a cooler IC, which is adapted to cool the air compressed by the compressor. The latter is caused to rotate by said turbine T. Furthermore, the turbocharger assembly can be of the type with a variable geometry and/or can comprise a waste gate valve WG housed on a bypass duct so as to allow at least a portion of the exhaust gas to bypass the aforesaid turbine.

The processing unit is configured to control the supply of the internal combustion engine, controlling the opening of the fuel injectors associated with each cylinder of the engine. Furthermore, a speed sensor SP is associated with the crankshaft CK so as to measure the speed of the engine; said sensor is operatively connected to the processing unit.

The processing unit is preferably configured to also control said waste gate valve and/or said variable geometry of the turbocharger assembly.

The torque delivered by the internal combustion engine evidently also depends on the contribution of the turbocharger assembly; therefore, the control strategy described above can also involve the control of the turbocharger assembly, for example coordinating the operation of the waste gate valve with the operation of the throttle valve.

In a spark-ignition engine, a similar result can be obtained by controlling the quantity of fuel injected into the cylinder/s of the internal combustion engine and/or through the control of the turbocharger assembly and/or through the control of the relative waste gate valve.

Figure 6:
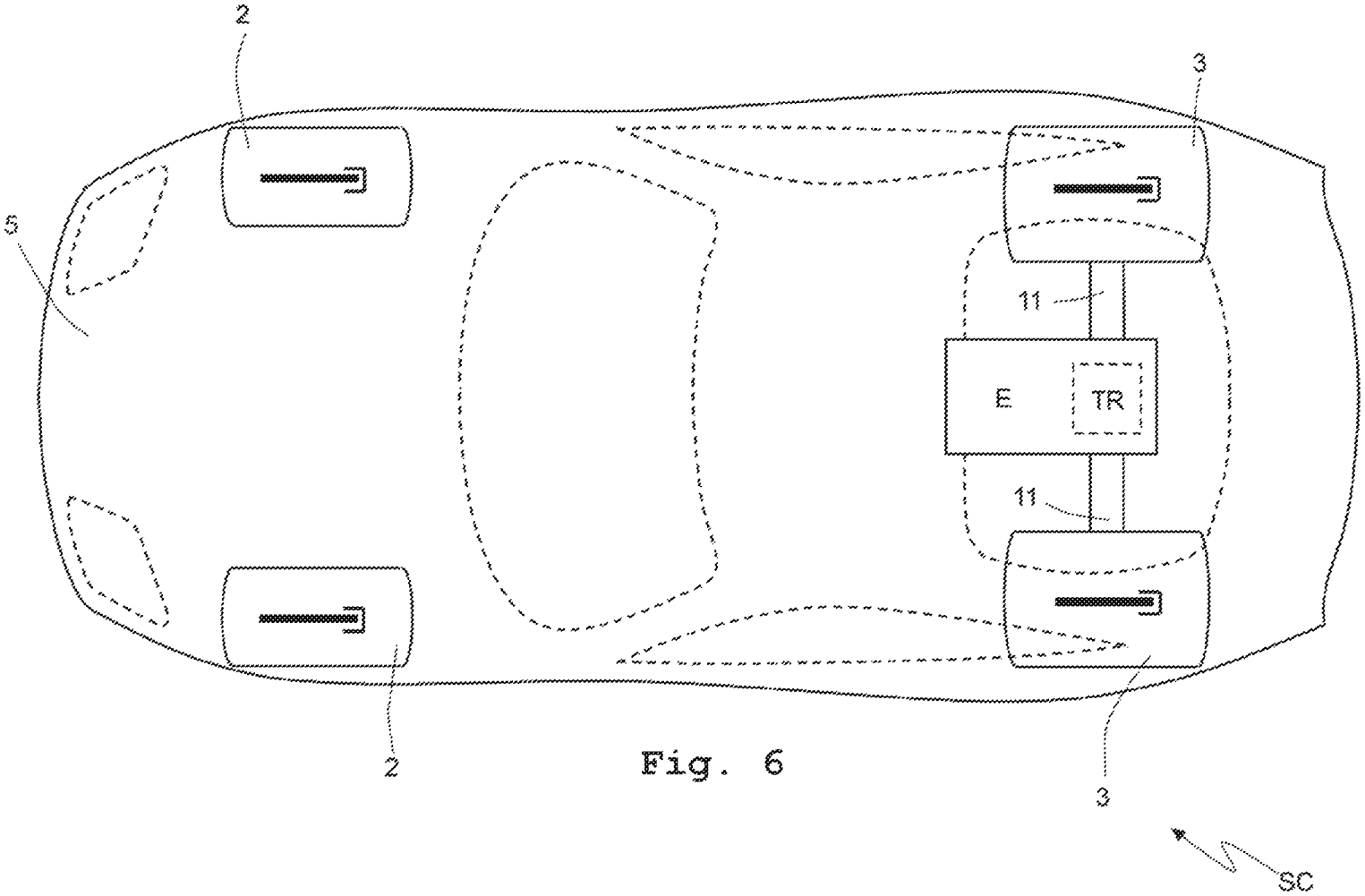
FIG. 6 shows a sports car provided with the internal combustion engine of FIG. 4 and a transmission.

FIG. 6 shows a sports car SC comprising an internal combustion engine E connected to the axle 11 of the drive wheels 3 by means of a transmission TR adapted to change a gear ratio, through a gearbox with discrete ratios or a CVT gearbox.

Even in case of a CVT gearbox with a continuously variable transmission, the values of the gear ratio can be made discrete allowing the values of the predetermined initial torque to be mapped, thus obtaining what described above.

By mere way of example, the sports car SC has the internal combustion engine arranged behind the passenger compartment of the vehicle, FIG. 6 also showing a front part 5 and the front wheels 2.

This invention can be advantageously implemented by means of a computer program comprising encoding means for carrying out one or more steps of the method, when the program is run on a computer. Therefore, the scope of protection is extended to said computer program and, furthermore, to means that can be read by a computer and comprise a recorded message, said means that can be read by a computer comprising program encoding means for carrying out one or more steps of the method, when the program is run on a computer.

The non-limiting example described above can be subjected to variations, without for this reason going beyond the scope of protection of the invention, comprising all embodiments that, for a person skilled in the art, are equivalent to the content of the claims.

When reading the description above, a skilled person can carry out the subject-matter of the invention without introducing further manufacturing details.

The invention claimed is:

1. A method for limiting a revolution speed of an internal combustion engine (E) of a sports car, the method comprising a first step (Step 1) of acquiring a nominal speed value of said internal combustion engine, a second step (Step 2) of measuring a revolution speed of said internal combustion engine, wherein the measured revolution speed is at an activation speed, wherein the activation speed is within 1 percent of the normal speed value;

a third step (Step 3) of setting a predetermined initial torque value (a) to be delivered by said internal combustion engine, which is smaller than a current delivered torque, so as to determine a slowing down of said internal combustion engine, and simultaneously a fourth step (Step 4) of carrying out a feedback control of a torque delivery of said internal combustion engine based on an error between said measured revolution speed and said nominal speed, so as to determine an increase in the speed of said internal combustion engine, until said activation speed is reached again.

2. The method according to claim 1, wherein said sports car comprises a transmission (TR) and a predetermined number of gear ratios, and wherein said predetermined initial torque comprises a number of values equal to said number of gear ratios and wherein the values of said predetermined initial torque have a 1:1 relationship with the gear ratios.

3. The method according to claim 1, further comprising a fifth step (Step 5) of acquiring a current gear ratio, wherein said fifth step is carried out immediately prior to said third step and wherein said third step further comprises a step of selecting (b) a value of said predetermined initial torque in response to said acquisition of said current gear ratio.

4. The method according to claim 1, wherein said predetermined initial torque is calculated or determined empirically so as to cause said internal combustion engine to reach and/or maintain said nominal speed.

5. The method according to claim 1, comprising a step of triggering a predetermined number of oscillations in said internal combustion engine speed having peaks coincident with said nominal speed, with a predetermined frequency and magnitude.

6. The method according to claim 5, wherein said predetermined initial torque is calculated or determined empirically so as to cause said internal combustion engine to slow down until reaching a reactivation speed which is below said activation speed, triggering an oscillation of the revolution speed of the internal combustion engine.

7. The method according to claim 6, wherein a frequency of said oscillation can be varied by varying the coefficients of said feedback control.

8. The method according to claim 6, wherein a magnitude of said oscillation can be varied by varying a value of said reactivation speed.

9. The method according to claim 5, further comprising, a sixth step (Step 6), simultaneous to setting the predetermined initial torque value (a) and carrying out the feedback control of the torque delivery, the sixth step (step 6) comprising cutting off a fuel supply to said internal combustion engine up to when said internal combustion engine reaches a reactivation speed which is below said activation speed.

10. The method according to claim 9, wherein said predetermined initial torque is calculated or determined empirically, so as to cause said internal combustion engine to exceed said nominal speed.

11. A processing unit (ECU) of an internal combustion engine (E) of a sports car configured to carry out the method of claim 1.

12. An internal combustion engine of a sports car comprising a processing unit according to claim 11.

13. A sports car comprising an internal combustion engine according to claim 12.

* * * * *